United States Patent [19]

Rech

[11] 4,394,944

[45] Jul. 26, 1983

[54] VALVED CLOSURE FOR DISPENSING CONTAINER

[75] Inventor: Jakob Rech, Detroit, Mich.

[73] Assignees: Jerome Applefield; Sheldon Applefield, both of Southfield, Mich.

[21] Appl. No.: 187,321

[22] Filed: Sep. 15, 1980

Related U.S. Application Data

[63] Continuation of Ser. No. 943,534, Sep. 18, 1978, abandoned, which is a continuation-in-part of Ser. No. 726,418, Sep. 24, 1976, Pat. No. 4,141,476.

[51] Int. Cl.[3] ..... B65D 47/30

[52] U.S. Cl. ..... 222/553; 222/554

[58] Field of Search ..... 222/545, 548, 553, 554, 222/568

[56] References Cited

U.S. PATENT DOCUMENTS

| | | | |
|---|---|---|---|
| 76,030 | 3/1868 | Zinsser | 222/568 |
| 1,476,700 | 12/1923 | Feldstein | 222/545 |
| 1,701,433 | 2/1929 | Witt | 222/545 |
| 1,725,689 | 8/1929 | Witt | 222/80 X |
| 1,772,379 | 8/1930 | Witt | 222/554 X |
| 2,822,111 | 2/1958 | Tripoli | 222/545 X |
| 3,116,857 | 1/1964 | Lehman et al. | 222/545 |

FOREIGN PATENT DOCUMENTS

| | | | |
|---|---|---|---|
| 612098 | 11/1948 | United Kingdom | 222/545 |

*Primary Examiner*—Joseph J. Rolla
*Assistant Examiner*—Frederick R. Handren
*Attorney, Agent, or Firm*—Hauke and Patalidis

[57] ABSTRACT

A valved closure for a container holding plastic or pasty material and having an opening generally in the form of a neck for dispensing the material from the container. The valved closure is permanently or, in the alternative, removably mounted over the neck of the container. The valved closure consists of a hollow housing with a dispensing aperture for placing the interior of the container in communication with the ambient and a rotatable valve body disposed proximate the aperture such as to obturate the aperture in a first position. The valve body has a passageway placing the interior of the housing in communication with the housing aperture by rotation to a second position. The valve body is directly actuatable by means of a lever. The housing dispensing aperture has at least one chamfered side forming a sharp cutting edge for a ribbon of pasty material being dispensed from the container and the periphery of the valve body projects slightly beyond the edges of the dispensing aperture. Although the valved closure of the invention is particularly well-suited for plastic or pasty material being dispensed, its use is not so limited and it is as effective as a means for dispensing liquid or powder materials.

9 Claims, 12 Drawing Figures

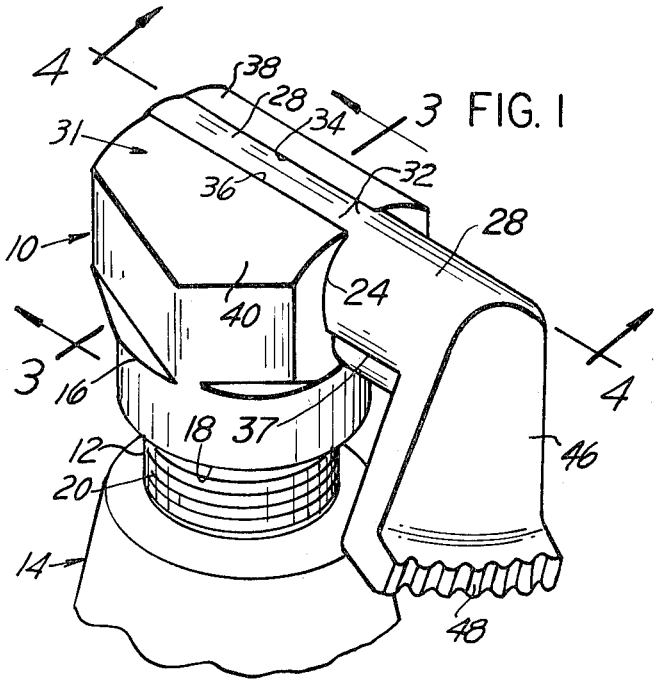
FIG. 1
FIG. 3
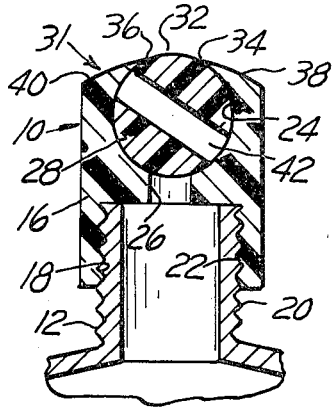
FIG. 4
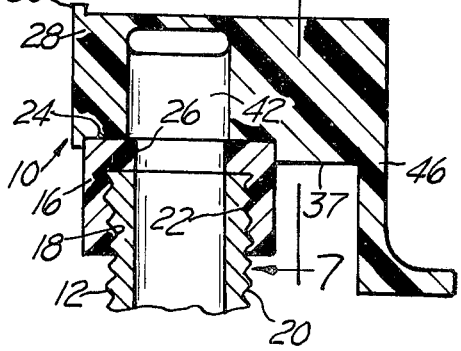
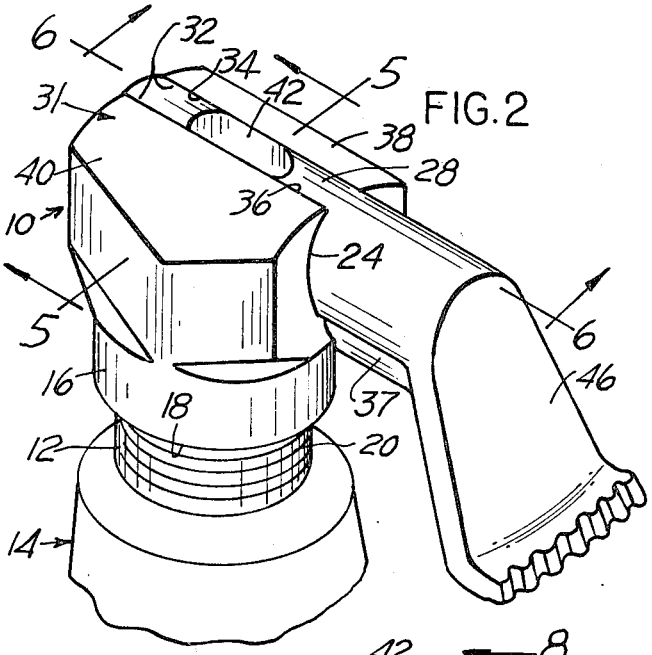
FIG. 2
FIG. 5
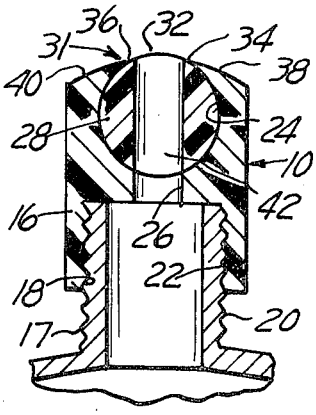
FIG. 6
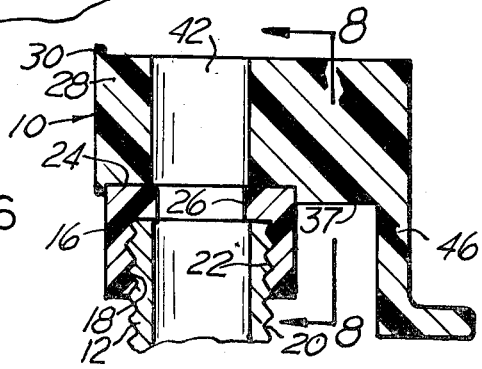

FIG. 7
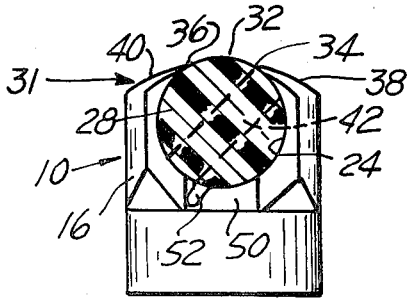
FIG. 8
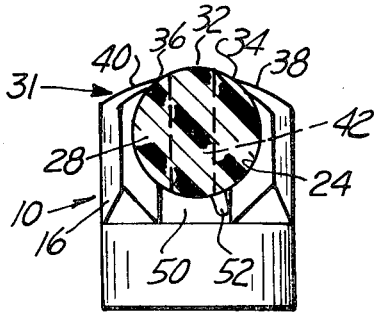
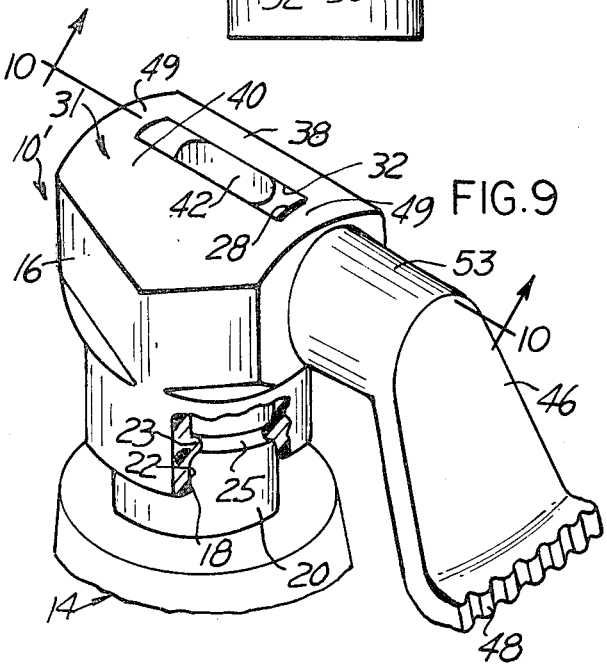
FIG. 9
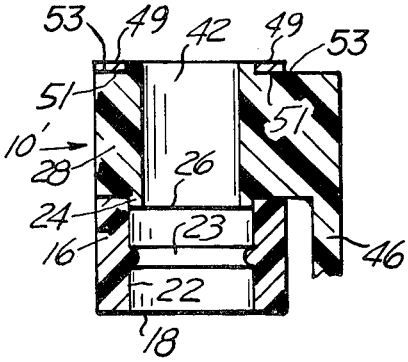
FIG. 10
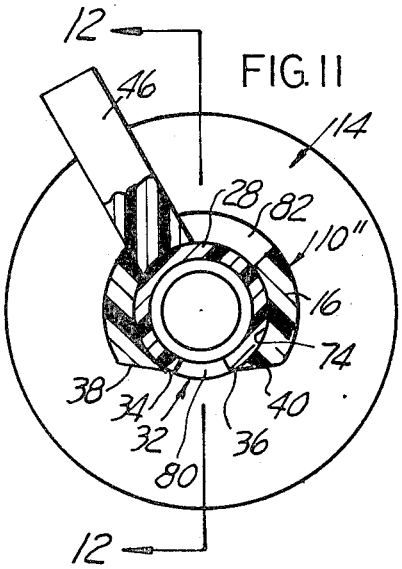
FIG. 11
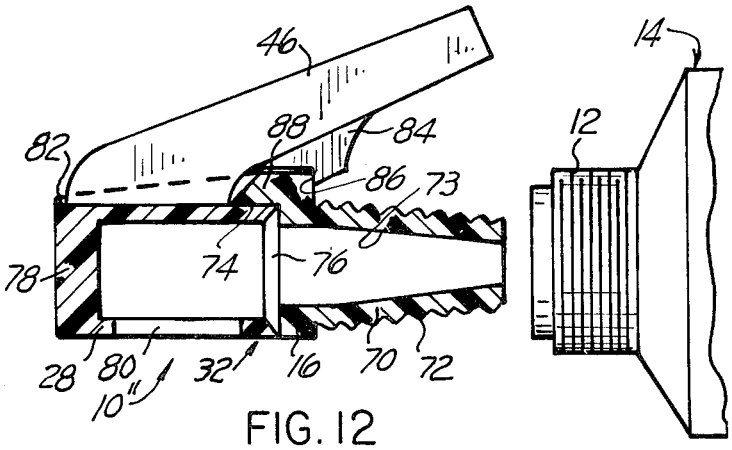
FIG. 12

VALVED CLOSURE FOR DISPENSING CONTAINER

CROSS-REFERENCE TO RELATED APPLICATIONS OR PATENTS

The present application is a continuation of application Ser. No. 943,534, filed Sept. 18, 1978, now abandoned, which is a continuation-in-part of application Ser. No. 726,418, filed Sept. 24, 1976, now U.S. Pat. No. 4,141,476, issued Feb. 27, 1979.

BACKGROUND OF THE INVENTION

The present invention relates to valved closures for containers used in packaging liquids, powders and more particularly pastes and like substances. Although the invention is useful as a closure and dispensing means for glass, plastic or metallic containers, it is particularly well-adapted to collapsible tubes of the kind used for packaging paste products such as toothpaste, hand and body lotions, shaving cream, paint pigments, paste food, cement and glue, and like material.

Such collapsible tubes, generally made of a soft metal and sometimes of thin pliable plastic, are designed to permit the contents to be ejected in desired quantities upon manual pressure being exerted on the wall of the tube. They are provided with a neck through which the contents are ejected, and the neck is generally peripherally threaded for cooperation with a threaded closure cap. When it is desired to remove a portion of the contents from the tube, the cap is removed, a desired portion of the contents is expelled and the remainder of the contents in the tube is sealed from the ambient by returning the cap to the threaded neck portion.

Although collapsible tubes with removable caps present may inconveniences, they have been generally accepted for many years as packaging and dispensing means for diverse products. A first inconvenience is that the threaded cap is often difficult to remove from the threaded neck portion, especially when the collapsible tube contains a material tending to dry and harden when exposed to the atmosphere. In view of the relative elasticity of the collapsible tube wall, it is often difficult to dispense a measured amount of the material contained in the tube, and the surplus amount of material must be wiped out from the neck aperture and from the neck thread, if it is desired to avoid excessive smearing and possibly the cap remaining stuck on the neck as a result of the material smearing the thread becoming dry and hardened. In addition, the material oozing from the neck to around the bottom of the cap presents a somewhat messy appearance that may result in unsanitary conditions. The cap may be easily dropped and lost, and replacement caps are not easily obtainable. When the collapsible tube is stored without the cap in position over the neck, the contents may ooze out from the tube or, if the contents of the tube consist of an air-hardenable material the contents of the tube in or near the neck portion becomes dry and hard to the point that it may become impossible to squeeze further material from the tube.

Dispensing spouts for containers have been proposed in the past to remedy the inconveniences of removable cap closures for containers. Examples of such structures may consist of an orientable spout, as disclosed in U.S. Pat. Nos. 2,866,580, and 2,790,583, for example which, in one position, places the interior of the container in communication with the ambient by registering with an appropriate dispensing aperture, and which, in a second position out of alignment with the aperture, isolates the interior from the ambient. Particularly when dispensing pasty material such an arrangement allows some of the material to remain in the spout and to dry out, although it is apparently perfectly suitable for dispensing liquids, especially liquids that are prone to evaporation such as lighter fluid and the like.

Other devices have been designed having a rotatable ball valve disposed in the neck of the container, as disclosed in U.S. Pat. Nos. 1,491,911, 1,960,393, 2,790,583, and 3,690,521 for example, the ball being provided with a passageway placing the interior of the container in communication with the ambient in one position and isolating the interior from the ambient in a second position wherein the passageway is engaged with a wall of the recess holding the ball. As the ball is elastically retained in a partially spherical socket, the use of too much pressure applied to the collapsible tube may expell the ball from its seat. If excessive pressure is externally applied on the ball, or if the container is dropped and the ball hits the ground, the ball may be pushed into the tube with the accompanying result that the closure becomes inoperable.

Other arrangements for dispensing closures which have been proposed, as disclosed in U.S. Pat. Nos. 1,476,700, 1,598,434 and 2,534,139, for example, consist of an apertured rotatable outer sleeve surrounding an apertured inner sleeve. When the outer sleeve is rotated to a position matching the apertures, material may be dispensed from the container. The container is closed by rotating the outer sleeve to a position removing the apertures from registry. Such an arrangement presents the inconvenience that it generally necessitates the use of both hands for operation, the outer sleeve is provided with an enlarged diameter knurled portion which interferes with neat dispensing of the material, and some amount of the material remains in the outer sleeve aperture which results in unsanitary conditions and, after the material becomes dry and hard, operation of the closure becomes difficult.

Another structure for valved closure for dispensing material contained in a container consists of a fitting fastened over the container dispensing neck provided with a dispensing aperture placing the interior of the container with the ambient, and having a rotatable cylindrical valve disposed proximate the dispensing aperture. The rotatable valve has a peripheral segment removed which, in one position of the valve, places the interior of the container in communication with the dispensing aperture. The valve body is rotated by means of a knob. In such a structure, however, the dispensing aperture is deeply recessed, thus interfering with the dispensing of the material and preventing wiping off the dispensing aperture edges, thus resulting in unsanitary conditions and the presence of residues at the dispensing aperture which may become dry and hard and cause difficulty in the operation of the valve.

SUMMARY OF THE PRESENT INVENTION

The inconveniences of the prior art relating to dispensing closures for containers are remedied by the present invention providing a valved closure taking the form of a housing attached to the container, and having a dispensing aperture for placing the interior of the container in communication with the ambient. A rotatable valve body is disposed proximate the dispensing aperture, and is movable from a position obturating the dispensing aperture to a position placing a passageway disposed through the valve body in registry with the dispensing aperture so as to permit material to be dispensed from the container. The valve body is directly actuated by a lever affixed to the valve body itself. The sides of the housing dispensing aperture are chamfered for the double purpose of forming a sharp cutting edge for a ribbon of pasty material being dispensed from the container and of providing a non-recessed dispensing aperture in the housing which may be kept clean and sanitary. The valved closure of the invention consists of only two simple molded parts and is thus capable of manufacture at high production rates and at a low cost.

BRIEF DESCRIPTION OF THE DRAWING

A better understanding of the present invention will be had by those skilled in the art when the following description of the best modes contemplated for practicing the invention is read in conjunction with the accompanying drawing wherein like reference numerals refer to like or equivalent parts and in which:

FIG. 1 is a perspective view of a valved closure for a container, according to the present invention, shown with the dispensing aperture closed;

FIG. 2 is a view similar to FIG. 1 but showing the dispensing aperture open;

FIG. 3 is a transverse sectional view along lines 3—3 of FIG. 1;

FIG. 4 is a longitudinal sectional view along line 4—4 of FIG. 1;

FIG. 5 is a transverse sectional view along line 5—5 of FIG. 2;

FIG. 6 is a longitudinal sectional view along line 6—6 of FIG. 2;

FIG. 7 is a transverse sectional view along line 7—7 of FIG. 4;

FIG. 8 is a transverse sectional view along line 8—8 of FIG. 6;

FIG. 9 is a view similar to FIG. 1, but showing a modification thereof, and with a portion broken away to show a detail of internal construction;

FIG. 10 is a longitudinal section thereof along line 10—10 of FIG. 9; and FIGS. 11 and 12 are respectively a transverse sectional view and a longitudinal sectional view of a further modification of the present invention.

DETAILED DESCRIPTION OF THE PREFERRED EMBODIMENTS

Referring now to the drawing and more particularly to FIGS. 1–8, there is illustrated a valved closure cap 10 according to the present invention fastened to the neck 12 of, for example, a collapsible tube 14. The valved closure 10 comprises a hollow housing 16, generally cylindrical and provided with an open end 18 adaptable for mounting over the neck 12 of the collapsible tube 14. In the example illustrated, and as best shown at FIGS. 3–4, the open end 18 of the housing 16 is screwed over the neck 12, the peripheral surface of the tube neck 12 being provided with a thread 20 engageable in a conforming inner thread 22 performed on the inside surface of the end 18 of the housing 16. In the example illustrated at FIGS. 1–3, the housing 16 is permanently, but still removably, attached to the tube neck 12 as a replacement for the conventional screw-on cap, not shown.

A circularly cylindrical recess or bore 24 is formed in the projecting end of the housing 16, such cylindrical recess extending from one side of the housing 16 to the other with its axis disposed substantially at right angle to the axis of a longitudinal bore 26 formed in the housing. A circularly cylindrical valve body 28 is rotatably disposed in the cylindrical recess 24, being held therein by way of any convenient means such as, for example, a slightly enlarged diameter portion or flange 30 (FIGS. 4 and 6), a radial projection, a diametrically disposed pin or the like. The nose 31 of the housing 16 is provided with a slotted dispensing aperture 32 extending from side to side of the housing, and through which slightly projects a portion of the peripheral surface of the cylindrical valve 28. The slotted aperture 32 has two substantially parallel longitudinal sides defining a pair of parallel sharp edges 34 and 36, for a purpose to be hereinafter described.

The flange 30 is preferably heat formed on the end of the cylindrical valve body 28 after inserting the cylindrical valve body into the bore 24 or, alternatively, it is preformed on the end of the cylindrical valve body 28 which is assembled to the housing 16 by pressing into the bore 24 of the housing 16. The material of which the housing 16 is molded being somewhat resilient, and the bore 24 being open to the top of the housing 16 due to the slotted dispensing aperture 32, the edges 34 and 36 of the dispensing aperture 32 are momentarily pushed apart to accommodate the preformed end flange 30, thus momentarily enlarging the bore 24 which resiliently returns to its original shape after the flange 30 has been pushed therethrough. A portion of the valve body 28 beyond the end of the bore 24 may be peripherally enlarged as shown at 37, as best seen at FIGS. 1 and 2, and thus the valve body 28 is securely held in position for rotation in the bore 24 and prevented from longitudinal motion therein by the flange 30 on one end and the peripherally enlarged portion 37 on the other end. The surface of the nose 31 of the housing 16 beyond the sharp edges of the slotted aperture 32 is separated in two lateral surfaces 38 and 40 which may be planar although disposed at an angle having its vertex at the longitudinal axis of the slotted aperture 32 or, as shown, slightly cylindrical with their peripheral cylindrical surface intersecting the cylindrical peripheral surface of the valve body 28. The valve body 28 is provided with a radially disposed elongated slit of a width at most equal to the width of the slotted aperture 32 and forming a passageway 42 placing the slotted aperture 32 in communication with the internal bore 26 in the housing 16. In a first position of the valve body 28, as illustrated at FIGS. 2, 5 and 6, the contents of the tube 14 may be forcibly expelled, by collapsing the tube, through the internal bore 26 of the housing 16, and through the passageway 42 and the slotted aperture 32. When the contents of the tube 14 consist of a pasty material such as toothpaste for example, a ribbon of the material is thus expelled from the tube. In order to terminate the dispensing of the material, the valve body 28 is rotated to the position shown schematically at FIGS. 1, 3 and 4 which removes the passageway 42 through the valve body 28 from registering with the slotted aperture 32 and the internal bore 26, thus hermetically closing the tube. The sharp edge 34 of the slotted aperture 32 acts as a shearing means for cutting off the ribbon of pasty material with the result that a clean, sharp break of the exact desired amount of dispensed material is obtained, and smearing of the lateral flat or curvilinear surfaces 38 and 40 is unlikely. Whatever light smearing may nevertheless result can easily be removed by wiping, such that the nose 31 of the housing 16 and the edges 34 and 36 of the slotted aperture 32 are always neat in appearance and are sanitary.

The valve body 28 is rotated by means of an integral lever 46 provided on its end with a serrated lateral edge 48 for finger operation, such as the thumb of the hand used for holding and collapsing the tube 14 for expelling the contents therefrom. The lever 46 is movable from the closed position shown at FIG. 1 to the open position shown at FIG. 2 and appropriate abutment means are provided for limiting the swinging of the lever 46 and therefore the amount of rotation of the valve body 28.

Such abutment means may take the form, for example, of a slot 50, FIGS. 7 and 8, formed at one end of the transverse bore 24 in the side of the housing 16, accepting a projecting abutment 52 formed integral on the peripheral surface of the valve body 28.

The valve body 28 with its integral lever 46 is assembled in the partially cylindrical transverse recess or bore 24, by pressing the valve body 28 into the recess or bore 24, and forming the flange 30, shown only at FIGS. 4 and 6, holding the valve body 28 in position by pinning, swaging, or by any other convenient means. In structure wherein both the valve body 28 and its integral lever 46 and the housing 16 are made of a thermoplastic, the flange 30 can be rapidly and conveniently formed by deforming the end portion of the valve body.

Instead of being removably mounted over the threaded neck of a container, a valved closure according to the present invention may be permanently mounted over the dispensing neck of the container by any appropriate means such as press-fitting, snapping or cementing. An example of permanent mounting of a valved closure 10′ on the neck 20 of a container 14, such as a collapsible tube, a bottle, a jar or the like, is illustrated at FIG. 9, wherein the open end 18 of the closure housing 16 is provided on its interior surface 22 with an annular ridge 23 engaged in a corresponding annular groove 25 formed in the periphery of the container neck 20. In the structure illustrated at FIG. 9, the valved closure 10′ is preferably made of a resilient plastic facilitating the coupling of the valved closure to the neck 20 of the container. Other than the arrangement for coupling the valve closure 10′ to the container neck, the structure of the valve closure 10′ is identical to that of the valved closure 10 of FIGS. 1–8, with a slight modification providing improved sealing of the contents of the container when the valved closure is closed. In the structure of FIGS. 9–10, the slotted dispensing aperture 32 does not extend from one end to the other end of the surface of the housing nose 31, a thin and relatively narrow bridge 49 integrally connecting the lateral surfaces 38 and 40 at each end of the dispensing slotted aperture 32. As best shown at FIG. 10, the valve body 28 has a reduced diameter portion 53 at each end, and the partially cylindrical transverse bore 24 in the housing 16, in which the valve body 28 is rotatably disposed, has a reduced diameter portion 51 formed at each end, which includes each a bridge 49 such as to correspond to each reduced diameter portion 53 of the valve body 28.

The valve body 28, provided with its integral lever 46, can easily be mounted in the cylindrical recess or bore 24 in the nose 31 of the housing 16 by pressing the valve body into the recess or bore. As the material forming the housing 16, preferably a plastic, is resilient, the enlarged diameter portion of the valve body 28 spreads apart the right-most reduced diameter portion 51 of the recess or bore 24, thus slightly increasing the diameter of the cylindrical recess or bore 24 and permitting the larger diameter portion of the valve body to be pushed through from one end of the cylindrical recess or bore 24 to the other, after which the wall of the cylindrical recess or bore reduced diameter portion 51 springs back to its original size, thus circularly holding the valve body 28 in position about its longitudinal axis but still permitting rotation of the valve body 28 within the partially cylindrical recess or bore 24, the enlarged diameter portion of the valve body 28 projecting slightly through the slotted aperture 32. Additionally, the end of the valve body 28 may be provided with a radially projecting flange which is formed after the valve body has been pressed in the recess or bore 24.

FIGS. 11–12 illustrate a further embodiment of the present invention. The valved dispenser 10″ consists of a substantially cylindrical housing 16 having a cylindrical internal bore 74 having a longitudinal axis substantially aligned with the longitudinal bore 73 of a tapered fitting 70 shown as made integral with the housing 16. The slotted dispensing aperture 32 is disposed on one side of the cylindrical housing 16 and, as in the previously described embodiments, has flat or curvilinear side surfaces 38 and 40 defining sharp edges 34 and 36. The side surfaces 38 and 40 preferably converge towards the centerline of the slotted aperture 32. A tubular cylindrical valve body 28 is rotatably disposed within the cylindrical bore 74, the peripheral surface of the valve body projecting slightly through the slotted dispensing aperture 32. The tubular cylindrical valve body 28 has an open end 76 aligned with the internal bore 73 of the fitting 70 and a closed forward end 78. A substantially rectangular aperture 80 is formed in the wall of the tubular valve body 28. A lever 46 is made integral or affixed to the valve body 38 and projects through a slot 82 in the wall of the housing 16. The slot 82 is wider than the thickness of the lever 46, such that by action through the lever 46 the valve body 28 may be rotated from a position wherein the aperture 80 through the wall of the tubular valve body 28 registers with the slotted aperture 32 in the wall of the housing 16, as illustrated at FIG. 11, whereby the contents of the tube or container 14 may be expelled, to a position out of registry, thus closing the tube or container.

Any convenient means may be used for holding the valve body 28 in the internal bore in the housing 16, such as grooves, ridges, pins, or the arrangement shown at FIG. 12 consisting of a projecting tongue 84 formed integral with the lever 46 and having an abutment 86 interfering with an enlarged diameter annular portion 88 of the housing 16 disposed about the open end of the housing. When the valve cylindrical body 28 is pushed into the cylindrical bore 74 during assembly, due to the resiliency of the material used for making the housing 16 and the integral valve body 28 and lever 46 the abutment 86 of the tongue 84 is caused to snap below the enlarged diameter annular portion 88 of the housing 16, thus preventing accidental removal of the valve body from the housing cylindrical bore.

Although the embodiment of FIGS. 11–12 has been described as consisting of a stationary housing 16 and a rotatable valve body 28, it will be readily apparent that the valve body 28 may be made stationary and affixed to the coupling 70 and the housing 16 disposed rotatably over the stationary valve body 28, in which case the lever 46 is attached directly to, or molded integral with the housing 16.

Although, it is readily apparent that the valved closure 10″ of FIGS. 11–12 may be provided with any one of the press-fit or threaded means for attaching to the neck of the container as previously explained, the valved closure 10″ is illustrated provided with means for attaching the valved closure to the neck 12 of the tube or container 14 which consist of a tapered tubular coupling 70 provided with serrations on its peripheral surface, or preferably threads as shown at 72, and having a longitudinal bore 73 aligned with the housing bore 18. Because of its tapered structure, the coupling 70 is capable of accommodating a range of internal diameters of tube necks, internally threaded or not, such that the valved dispenser of the invention, when provided with the coupling means of the threaded tapered coupling 70, can be used in combination with a variety of collapsible tubes or containers of different sizes having necks of different sizes within a range. It will be readily apparent that the coupling means of the structure of FIGS. 11–12 may also be used instead of the coupling means for the embodiments of FIGS. 1–10.

Having thus described the present invention by way of examples of structural embodiments, modifications whereof will be apparent to those skilled in the art, what is claimed as new is as follows:

1. A closure cap for a dispensing container, said closure cap being operable by a finger of the hand holding said container, said closure cap comprising a housing, means for attaching said housing in communication with the interior of said container, a substantially rectangular slotted dispensing aperture formed in a wall of said housing, a pair of exterior side surfaces on said housing each extending along one of a pair of opposite edges of said slotted dispensing aperture, said side surfaces being mutually disposed such as to substantially converge toward the centerline of said slotted dispensing aperture and to extend away from said aperture to a point below said slotted dispensing aperture centerline, a cylindrical bore having an axis parallel to the centerline of said slotted dispensing aperture and disposed in said housing such as to be intersected by said slotted dispensing aperture, a cylindrical valve body disposed rotatably in said bore and extending at least from one side of said housing to an opposite side, said cylindrical valve body having a peripheral surface normally obturating said slotted dispensing aperture and projecting slightly through said slotted dispensing aperture, said valve body having a radial passageway therethrough placing the interior of said housing in communication with the exterior of said housing through said slotted dispensing aperture when said valve body is rotated in said bore from a first position whereby said passageway is out of registration with said slotted dispensing aperture to a second position whereby said passageway registers with said slotted dispensing aperture, said slotted dispensing aperture having each of said pair of opposite side edges chamfered such as to be substantially tangential to and diverging from the peripheral surface of said valve body and forming at least one sharp edge engaging the peripheral surface of said valve body whereby a ribbon of pasty material dispensed from said container is sheared off upon rotation of said valve body from said second to said first position, said peripheral surface of said cylindrical valve body projecting beyond the opposite edges of said slotted dispensing aperture such that cleaning of the edges of said aperture is greatly facilitated, an elongated lever integral with said valve body and extending generally alongside the longitudinal axis of the dispensing container from the neck toward the bottom portion of said dispensing container, said lever being for rotation of said valve body by a finger and having a substantial surface engageable by said finger, means holding said valve body in position for rotation in said bore and preventing longitudinal motion therein, said means comprising a slot through said housing formed opposite said slotted dispensing aperture, said lever projecting through said slot and being adapted to engage one side of said slot for limiting rotation of said valve body in one direction to said first position and to engage the other of said slot for limiting rotation of said valve body in opposite direction to said second position, said slot having a length corresponding substantially to the dimension of said lever along the longitudinal axis of said valve body such as to prevent longitudinal motion of said valve body in said cylindrical bore in said housing, wherein said valve body is a hollow cylinder having a closed end and an open end placing the interior of said housing in communication with the exterior of said housing through the passageway in said valve body, said passageway being a substantially rectangular aperture in the wall of said cylinder.

2. The closure cap of claim 1 wherein said dispensing container has a neck with a peripheral thread and said housing has an open end provided with an internal thread for engagement with said peripheral thread.

3. The closure cap of claim 1 wherein said housing has an open end with an annular ridge on its interior surface engaged in a corresponding annular groove formed in the periphery of the neck of said container.

4. The closure cap of claim 1 wherein said dispensing container has a neck made of substantially soft material and said housing has an open end provided with a tapered tubular projection having a peripheral thread for engagement within said neck.

5. A closure cap for a dispensing container, said closure cap being operable by a finger of the hand holding said container, said closure cap comprising a housing, means for attaching said housing in communication with the interior of said container, a substantially rectangular slotted dispensing aperture formed in a wall of said housing, a pair of exterior side surfaces on said housing each extending along one of a pair of opposite edges of said slotted dispensing aperture, said side surfaces being mutually disposed such as to substantially converge toward the centerline of said slotted dispensing aperture and to extend away from said aperture to a point below said slotted dispensing aperture centerline, a cylindrical bore having an axis parallel to the centerline of said slotted dispensing aperture and disposed in said housing such as to be intersected by said slotted dispensing aperture, a cylindrical valve body disposed rotatably in said bore and extending at least from one side of said housing to an opposite side, said cylindrical valve body having a peripheral surface normally obturating said slotted dispensing aperture and projecting slightly through said slotted dispensing aperture, said valve body having a radial passageway therethrough placing the interior of said housing in communication with the exterior of said housing through said slotted dispensing aperture when said valve body is rotated in said bore from a first position whereby said passageway is out of registration with said slotted dispensing aperture to a second position whereby said passageway registers with said slotted dispensing aperture, said slotted dispensing aperture having each of said pair of opposite side edges chamfered such as to be substantially tangential to and diverging from the peripheral surface of said valve body and forming at least one sharp edge engaging the peripheral surface of said valve body whereby a ribbon of pasty material dispensed from said container is sheared off upon rotation of said valve body from said second to said first position, said peripheral surface of said cylindrical valve body projecting beyond the opposite edges of said slotted dispensing aperture such that cleaning of the edges of said aperture is greatly facilitated, an elongated generally L-shaped lever formed integral with an end of said valve body and extending generally alongside the longitudinal axis of the dispensing container from the neck toward the bottom portion of said dispensing container, said lever being for rotation of said valve body by a finger and having a substantial surface engageable by said finger, means on said cylindrical valve body holding said valve body in position for rotation in said bore and preventing longitudinal motion therein, wherein said last mentioned means comprises a narrow bridge integrally connecting said exterior side surfaces on said housing at each end of said dispensing slotted aperture, said valve body has a reduced diameter portion at each end and said cylindrical bore in said housing has a reduced diameter portion formed at each end, said reduced diameter portion of said cylindrical bore including each said bridge such as to correspond with each said reduced diameter portion of said valve body, and abutment means on said valve body and said housing limiting the amount of rotation of said valve body from said first position to said second position, said abutment means comprising a slot formed at one end of said cylindrical bore in a side of said housing accepting a projecting abutment formed integral on the peripheral surface of said valve body.

6. The closure cap of claim 5 wherein said dispensing container has a neck with a peripheral thread and said housing has an open end provided with an internal thread for engagement with said peripheral thread.

7. The closure cap of claim 5 wherein said housing has an open end with an annular ridge on its interior surface engaged in a corresponding annular groove formed in the periphery of the neck of said container.

8. The closure cap of claim 5 wherein said dispensing container has a neck made of substantially soft material and said housing has an open end provided with a tapered tubular projection having a peripheral thread for engagement within said neck.

9. The closure cap of claim 5 wherein said elongated generally L-shaped lever has serrated lateral edge means on the end of said lever for easy finger operation of said valve body.

* * * * *